US012637118B2

(12) United States Patent
Grau

(10) Patent No.: US 12,637,118 B2
(45) Date of Patent: May 26, 2026

(54) DRAWBAR FOR VEHICLE COUPLER

(71) Applicant: Dellner Couplers AB, Falun (SE)

(72) Inventor: Curtiss A. Grau, Duncan, SC (US)

(73) Assignee: Dellner Couplers AB, Falun (SE)

( * ) Notice: Subject to any disclaimer, the term of this patent is extended or adjusted under 35 U.S.C. 154(b) by 939 days.

(21) Appl. No.: 17/481,280

(22) Filed: Sep. 21, 2021

(65) Prior Publication Data

US 2023/0093266 A1 Mar. 23, 2023

(51) Int. Cl.
*B61G 9/00* (2006.01)
*B61G 9/20* (2006.01)

(52) U.S. Cl.
CPC *B61G 9/20* (2013.01); *B61G 9/00* (2013.01)

(58) Field of Classification Search
CPC ..... B61G 9/20; B61G 9/00
USPC ..... 213/7, 62 R
See application file for complete search history.

(56) References Cited

U.S. PATENT DOCUMENTS

| | | | | |
|---|---|---|---|---|
| 2,681,157 | A * | 6/1954 | Metzger | B61G 9/24 213/69 |
| 3,152,699 | A * | 10/1964 | Vickerman | B61G 7/10 213/49 |
| 5,176,268 | A * | 1/1993 | Manley | B61G 7/10 213/50 |
| 6,499,613 | B1 * | 12/2002 | Grau | B61G 7/14 213/7 |
| 10,308,262 | B2 * | 6/2019 | Westman | B61G 11/16 |
| 10,464,381 | B2 | 11/2019 | Eliasson et al. | |
| 2001/0011648 | A1 * | 8/2001 | Summa | B61B 10/022 213/7 |

* cited by examiner

*Primary Examiner* — S. Joseph Morano
*Assistant Examiner* — Heaven R Buffington
(74) *Attorney, Agent, or Firm* — Howard IP Law Group, PC

(57) ABSTRACT

A drawbar for a vehicle coupler includes a drawbar tail, the drawbar tail configured at a distal end for connecting to a vehicle, and at a proximal end for engagement with a drawbar body; a drawbar body, the drawbar body configured for receiving a draft gear, the drawbar body further defining a path for movement of the proximal end of the drawbar tail. The drawbar body and drawbar tail are connected by a releasable connection. A block inserted via an opening in the drawbar body blocks the path to restrain movement of the drawbar tail during towing, after release of the releasable connection.

15 Claims, 6 Drawing Sheets

DRAWBAR FOR VEHICLE COUPLER

FIELD OF THE INVENTION

The application relates to devices for providing a mechanical coupling between vehicles, for example, railcars or mass transit rail vehicles.

BACKGROUND OF THE INVENTION

Series connected vehicles, such as railcars, are typically mechanically attached to one another via coupling devices or couplers. These couplers often include a rigid drawbar connected with a dampening device, such as a draft gear, for absorbing normal tension (draft) and compression (buff) forces, resulting in a degree of travel between connected vehicles. In the event of excess buff forces, such as those generated during a collision, a release mechanism may also be provided for permitting additional travel of the coupler relative to a vehicle associated therewith. Release mechanisms may include, for example, a plurality of bolts or pins arranged between various components of the coupler. The release of these elements allows for additional relative motion between components.

A number of goals are desired from a coupler arrangement in response to excess forces during a collision. It is desired that the coupler arrangement have no or minimal parts that may be able to be separated and dropped onto a roadbed. Desirably, the coupler arrangement remains suitable for permitting towing of damaged vehicles. In the prior art, coupler arrangements have been provided which provide for a towing connection between damaged vehicles. An example of such a prior art coupler arrangement is shown in U.S. Pat. No. 6,499,613. However, such coupler arrangements require at least partial disassembly in order to verify that all components required for towing are properly installed.

Vehicle couplers that have both release characteristics as described above, as well as the ability to be conveniently utilized for towing after a collision, are desired.

SUMMARY

In an embodiment of the present disclosure, a drawbar for a vehicle coupler has a first portion configured at a distal end for connecting to a first vehicle; a second portion comprising a housing for receiving a dampening device, for connection to a second vehicle, the second portion configured for engagement with a proximal end of the first portion; and a block inserted in the second portion via an opening in a wall of the second portion. The first and second portions are configured for connection via a release mechanism, and, wherein, responsive to release of the release mechanism, the first and second portions are slidably movable in a first direction, and slidably movable in a second direction, opposite to the first direction, to the block.

In another embodiment of the present disclosure, a drawbar for a vehicle coupler includes a drawbar tail, the drawbar tail configured at a distal end for connecting to a vehicle, and at a proximal end for engagement with a drawbar body; a drawbar body, the drawbar body configured for receiving a draft gear, the drawbar body further defining a path for movement of the proximal end of the drawbar tail. The drawbar body and drawbar tail are connected by a releasable connection. A block inserted via an opening in the drawbar body blocks the path to restrain movement of the drawbar tail during towing, after release of the releasable connection.

In another embodiment of the present disclosure, a drawbar body for a vehicle coupler includes a portion for releasable connection to a draft gear, and a top plate, having upstanding parallel rails, the parallel rails each having grooves defined therein, for receiving and defining a linear path for travel of a plate of a drawbar tail. The drawbar body further includes an opening through a wall of the drawbar body and into at least one of the grooves, for receiving a key.

DETAILED DESCRIPTION

Figure 1:
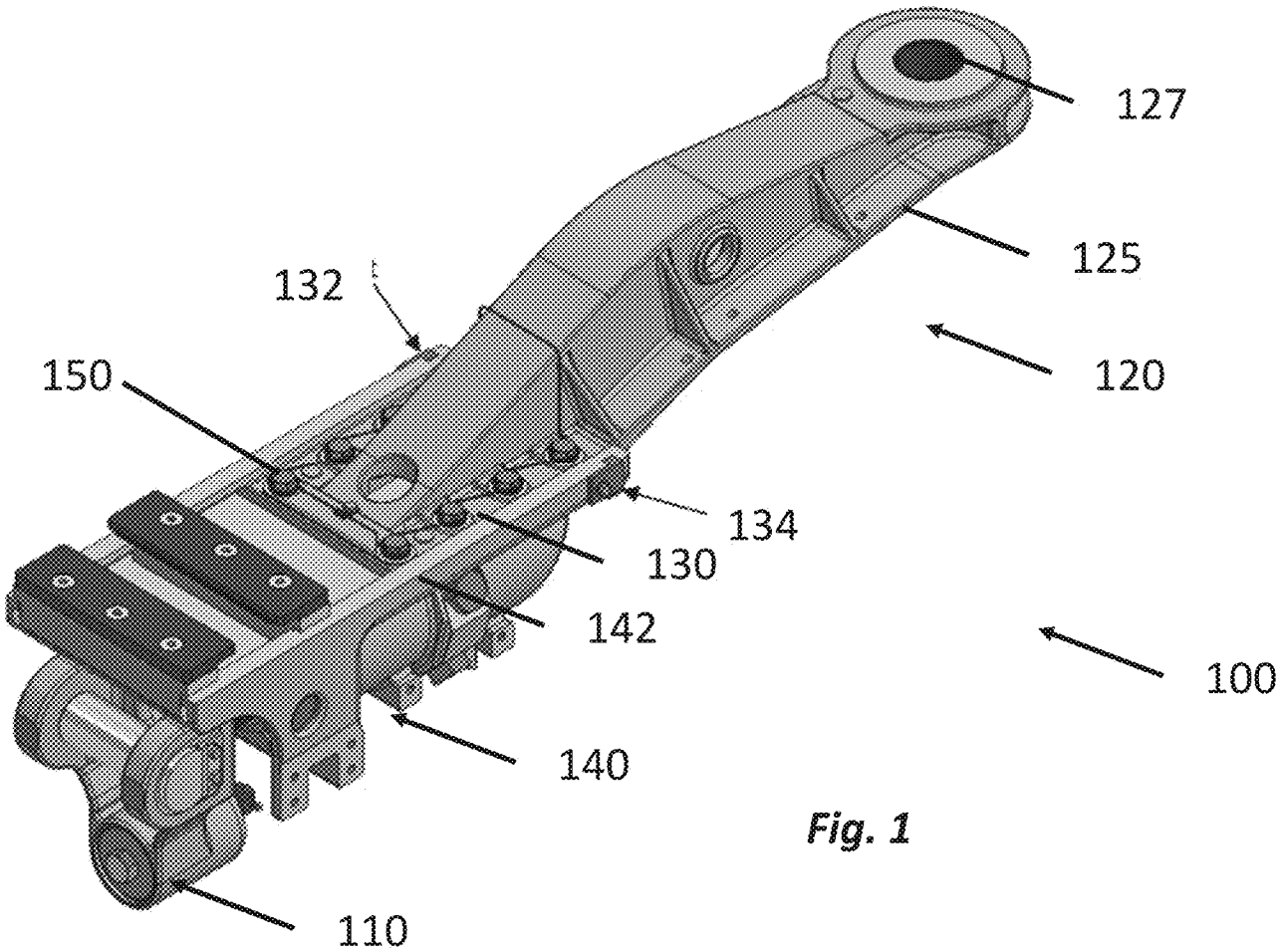
FIG. 1 is a perspective view of a drawbar according to an embodiment of the present disclosure.

It is to be understood that the figures and descriptions of the present invention have been simplified to illustrate elements that are relevant for a clear understanding of the present invention, while eliminating, for purposes of clarity, many other elements found in typical vehicle coupling systems. However, because such elements are well known, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present disclosure are directed to improved coupling devices for vehicles, such as railway cars. In one embodiment, a vehicle coupler comprises a coupling head configured to be attached on one end thereof to a corresponding coupling head of another vehicle. The coupling head is attached at another end thereof to a dampening device or mechanism, such as a draft gear. At least a portion of the dampening mechanism is arranged within a housing. The housing may also be referred to a drawbar body, and the drawbar body is connected to a beam or drawbar tail to make up the drawbar. The drawbar tail is configured at its distal end to connect to a vehicle. The drawbar tail is connected, at its proximal end, to the drawbar body via a plate that constitutes an integral part of the drawbar tail. The plate is located at the end of the drawbar tail at the drawbar body, or the proximal end of the drawbar tail. The opposite end of the drawbar tail, or distal end, is, as noted, configured to connect to the vehicle.

The plate of the drawbar tail has opposite straight parallel sides that are received in grooves defined in upstanding parallel rails extending up from each side of the drawbar body. A top surface of the drawbar body intermediate the rails is a planar surface on which a lower surface of the plate of the drawbar tail may slide when not fixed.

In embodiments, the sliding connection between the drawbar tail and the drawbar body may take forms other than a combination of edges of a plate of the drawbar tail received in a groove of rails on the drawbar body. For example, the edges of the drawbar tail may be configured having grooves defined therein, and the rails upstanding from the drawbar body may have lateral or horizontal extensions for being received in the grooves in the edges of the drawbar tail. Other configurations of grooves defined in one of the drawbar body and the drawbar tail to receive protrusions, which may be straight and elongated, from the other one of the drawbar body and the drawbar tail, may be provided. The configuration serves to constrain motion of the drawbar tail relative to the drawbar body in a linear path along a longitudinal axis of the drawbar body.

The plate of the drawbar tail is fixed to the drawbar body during ordinary operation by a releasable securing mechanism that releases upon application of a sufficient force. The releasable securing mechanism is designed to release upon application of compression forces above a threshold in the event of a collision. The releasable securing mechanism may be in the form of one or more frangible bolts extending through apertures in the plate of the drawbar tail and the top surface of the drawbar body. On release, or breaking of the frangible bolts, the drawbar tail may slide in a linear path along a longitudinal axis of the drawbar body. In embodiments, if a stop positioned to halt movement of the drawbar tail responsive to compressive forces is provided, the drawbar tail will slide to the stop. In embodiments, if no stop positioned to halt movement of the drawbar tail responsive to compressive forces is provided, the drawbar tail will continue to slide until the compressive forces cease. For example, the compressive forces may be absorbed by deformation of components of the respective vehicles that have engaged.

In the overall coupler apparatus, the releasable securing mechanism is a secondary emergency release mechanism. A primary emergency release mechanism provides a releasable connection between the draft gear, or dampening mechanism, and the drawbar body. This primary releasable connection provides for additional travel of the draft gear relative to the drawbar body in the event of buff/compression forces exceeding a first threshold. Responsive to buff forces exceeding a second threshold, the secondary emergency release mechanism releases, permitting the drawbar tail to slide relative to the drawbar body. The sliding of the drawbar tail relative to the drawbar body allows leading portions of the two vehicles, such as collision emergency management system features, to engage and absorb the forces of the collision.

After a collision involving railcars or other vehicles, it is desirable to tow the damaged vehicles. Towing of one of the vehicles will cause the plate of the drawbar tail to slide relative to the drawbar body in the path defined by the grooves in the rails on the drawbar body. Embodiments provide a stop, positioned in the path defined by the grooves in the rails, at or near the distal end of the path. The stop is positioned by being press fit into a corresponding opening in the drawbar body. The stop may be termed a "key," as the stop fits into the corresponding opening. The stop is rigidly positioned in the drawbar body via the press fit. The mechanical stop may further be fixed to the drawbar body via a fastener. In embodiments, the fastener is not loaded in shear, and not loaded in tension. Two mechanical stops may be provided, such as one mechanical stop at each side of the path. The mechanical stop, or multiple stops, are rigid bodies that serve to transfer the load of the car being towed between the drawbar body and the drawbar tail.

Multiple advantages are provided by the stop inserted in an opening in the drawbar body to block the path of the drawbar tail. As the stop or stops are inserted into a corresponding opening in the drawbar body, the presence of the stops may be confirmed on visual inspection of the drawbar. If the stops are absent, the opening, and the absence of the key, will be noted on visual inspection. No disassembly of the drawbar is required in order to confirm the presence of the stop or key. In embodiments, the openings in the drawbar body are through a sidewall of the drawbar body; stops or keys fit into openings through a sidewall are visible on visual inspection from the side. In embodiments, the openings in the drawbar body may be through a wall other than a sidewall, such as a lower wall of the drawbar body; stops or keys fit into openings through a lower wall, or other wall, of the drawbar body, will be visible on visual inspection from a vantage point other than from the side.

In assembling the drawbar by attaching the drawbar tail to the drawbar body, the stop or key may be inserted either before or after fastening of the drawbar tail to the drawbar body. Replacement of fasteners that secure the drawbar tail to the drawbar body can be accomplished without removal of the keys. Replacement of keys or fasteners for the keys can be accomplished without removal of the fasteners releasably securing the drawbar body to the drawbar tail.

Referring now to FIG. 1, there is shown an embodiment of a drawbar 100 according to an embodiment of the present disclosure. The drawbar 100 includes a drawbar tail, or first portion, 120, and a drawbar body, or second portion, 140. The drawbar tail 120 includes an elongated beam 125 configured for attachment to a body of a first vehicle (not shown), such as via bore 127 at its distal end configured to receive a corresponding pin of the first vehicle. The drawbar tail 120 further includes an element configured to be releasably fixed on the drawbar body and connected via a sliding connection to the drawbar body. Responsive to release of the releasable connection, the element of the drawbar tail is movable, via the sliding connection, in a linear path along a longitudinal axis of the drawbar body. In the illustrated embodiment, the element configured to be releasably connected to the drawbar body is plate 130. Plate 130 and beam 125 may be integrally formed, such as being machined from a single cast piece of a suitable steel alloy, or formed from two or more parts that are joined such as by welding or fasteners.

In an embodiment, plate 130 is in the form of a rectangular plate having two opposing planar surfaces. Plate 130 is configured for releasable connection to the drawbar body. The configuring of plate 130 for releasable connection to the drawbar body may be via a plurality of bores extending between the planar surfaces to accommodate releasable fasteners 150, which may be shear bolts or shear pins, or frangible bolts or frangible pins.

The drawbar body 110 is configured for releasable connection to drawbar tail 120. The configuring for releasable connection may be by providing bores configured to align with bores in a portion of drawbar tail 120, so that releasable fasteners, such as frangible bolts or frangible pins 150, may be disposed through the respective bores in both the plate portion of drawbar tail 120 and a mating surface of drawbar body 140.

The drawbar body 140 and drawbar tail 120 are configured for relative slidable movement responsive to releasing of the releasable connection. The drawbar body and drawbar tail are configured so that the slidable movement is constrained to be linear, along a single axis, and between two stops providing for a maximum movement along the single axis. The drawbar body may define a path that constrains movement of the drawbar tail to linear motion along a single axis. The drawbar tail 120 may have a portion of a plate, or, as shown, two plates joined by a central body portion, and the drawbar body may include a planar top surface, having a pair of parallel rails 142 extending therefrom, the rails having grooves 143, shown in FIGS. 3 and 4, defined therein dimensioned to receive edges of the plate.

A draft gear 110 is illustrated in the drawbar body. In normal operation, the draft gear absorbs buff forces, i.e., compressive forces, and draft forces, i.e., tension forces. The draft gear is mechanically connected to the drawbar body via a first releasable connection, which may be, by way of example, a threaded, bolted or pinned connection. The first releasable connection maintains the draft gear fixed relative to the drawbar body during ordinary operation of the vehicles, only releasing when compressive or tension forces exceed a first threshold. The draft gear is positioned adjacent to the first releasable connection. A variety of arrangements for mounting the draft gear relative to the drawbar body and for providing a first releasable connection between the draft gear and the drawbar body are known in the art.

A stop or key 132 is shown inserted in the drawbar body on one side, and a second stop or key 134 shown inserted in the drawbar body on the opposite side. The stop or key 132 is inserted in an opening through a sidewall of the drawbar body on one side, and the second stop or key 134 is inserted in an opening through an opposite sidewall of the drawbar body.

Figure 2:
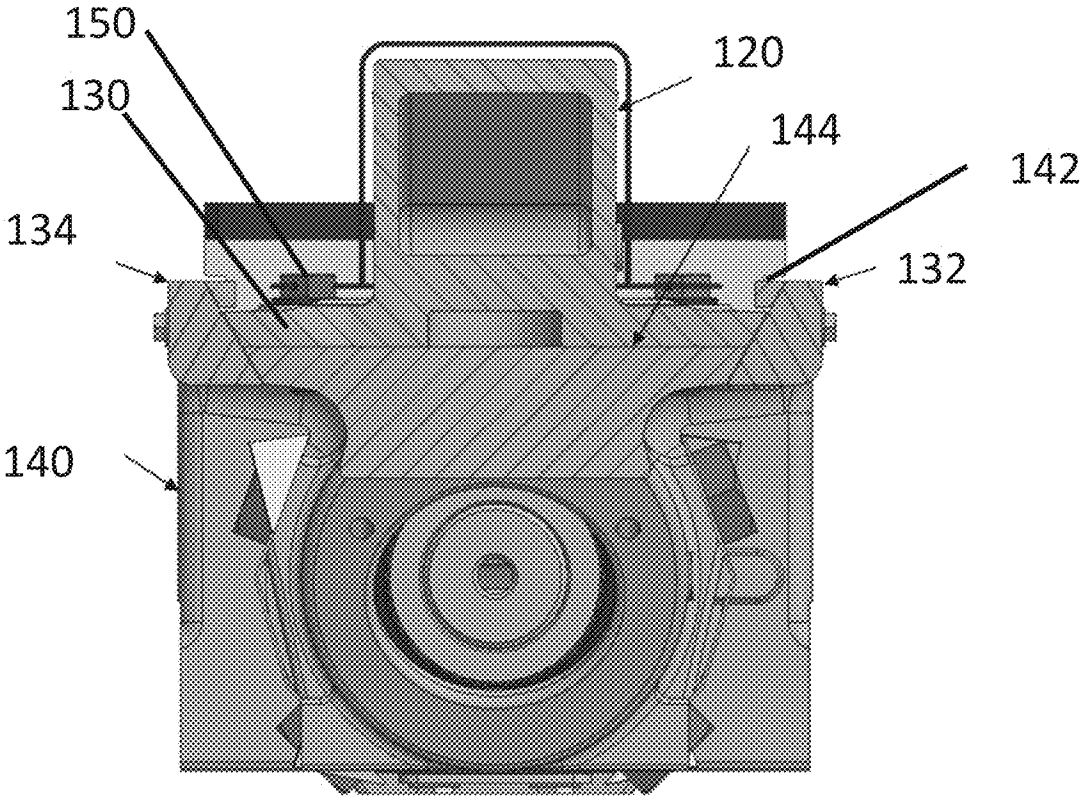
FIG. 2 is a cross-sectional view of the drawbar of FIG. 1.

Referring now to FIG. 2, there is shown a cross-sectional view of the drawbar 100 taken through the keys of FIG. 1. The keys 132, 134 are seen to have inner faces that have a diagonal orientation so as to extend inward, toward a center of drawbar body 140 into a travel path. The upstanding rails, the grooves defined in the inner faces of the rails, and the planar surface of the drawbar body may be seen as defining the travel path. The travel path is linear, and parallel to a longitudinal axis of the drawbar body.

Figure 3:
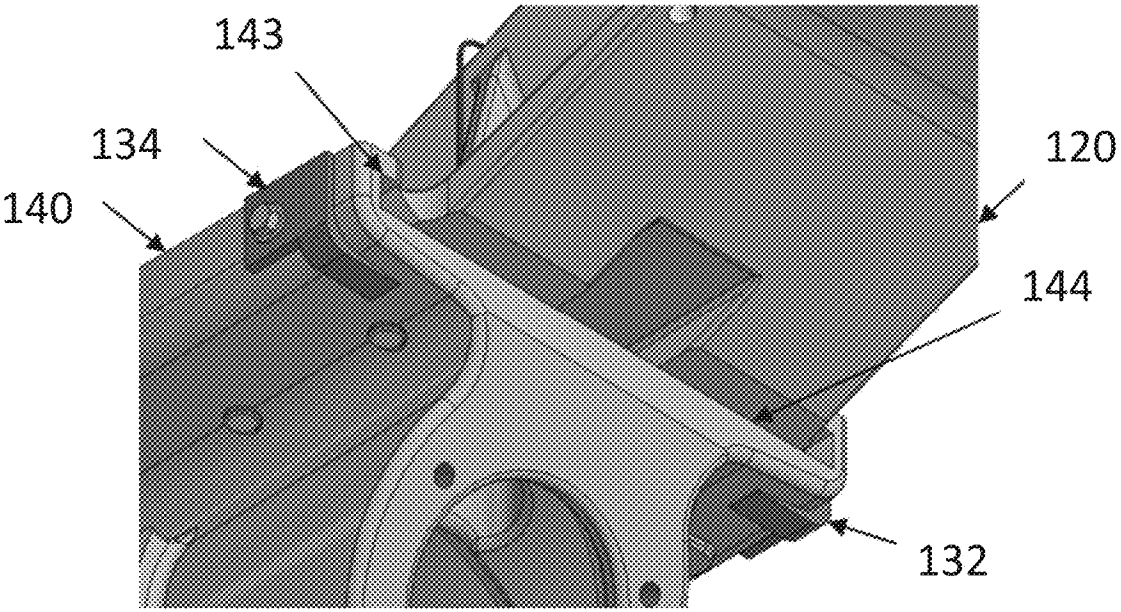
FIG. 3 is a partial perspective view of the drawbar of FIG. 1.
Figure 4:
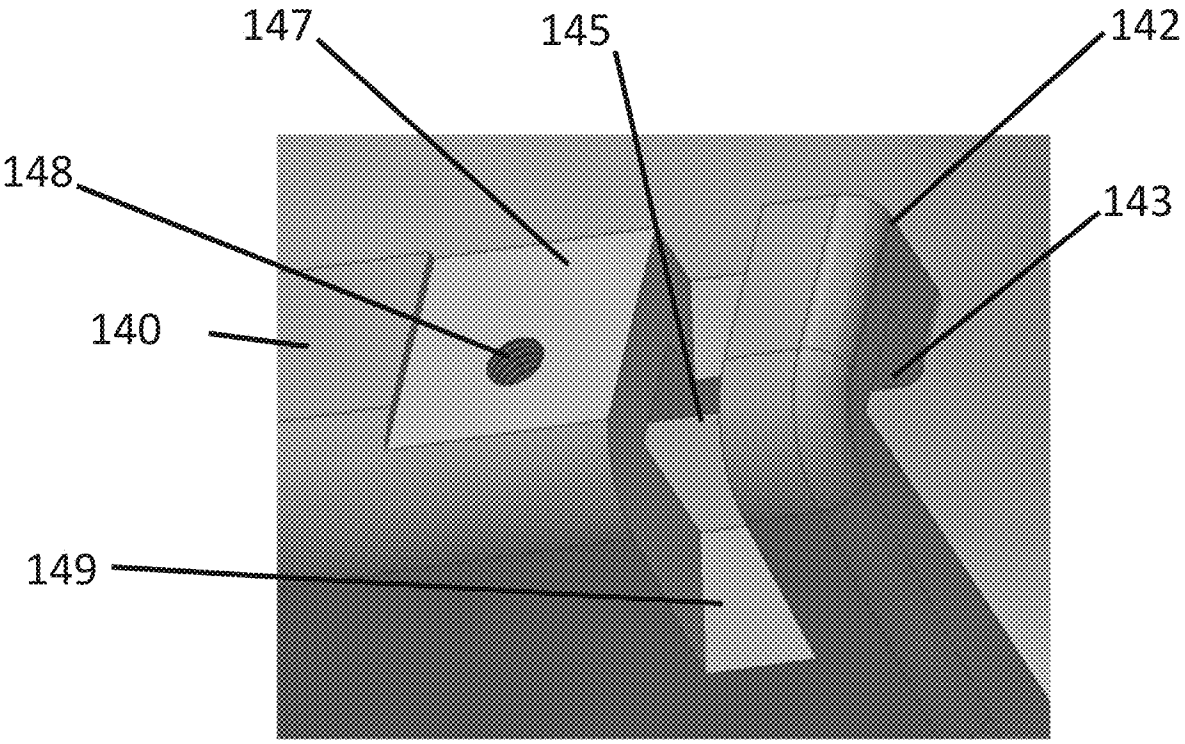
FIG. 4 is a partial perspective view of the drawbar body of the drawbar of FIG. 1, showing an opening therein.

Referring now to FIG. 3, there is shown a partial perspective view of the drawbar body 140 of FIG. 1. In FIG. 3, the keys or blocks shown in FIG. 1 are removed for purpose of illustration. The drawbar body includes through opening 145 shown in FIG. 4. The opening 145 extends into the upstanding rail, and through the lower portion of the rail. A beveled surface 149 is defined in the body, below the upstanding rail. A well 147 is defined in the outer surface of the drawbar body. The well 147 is shallow in comparison to opening 145. A bore 148 is defined within well 147 through a wall of the drawbar body. The opening 145 is configured to receive key 134, which may be press fit into the opening. The well 147 is configured to receive a flange of key 134. A corresponding bore provided in the flange, with the bores aligning, permits a fastener to be positioned through the bores to fasten the key to the drawbar body.

Figure 5:
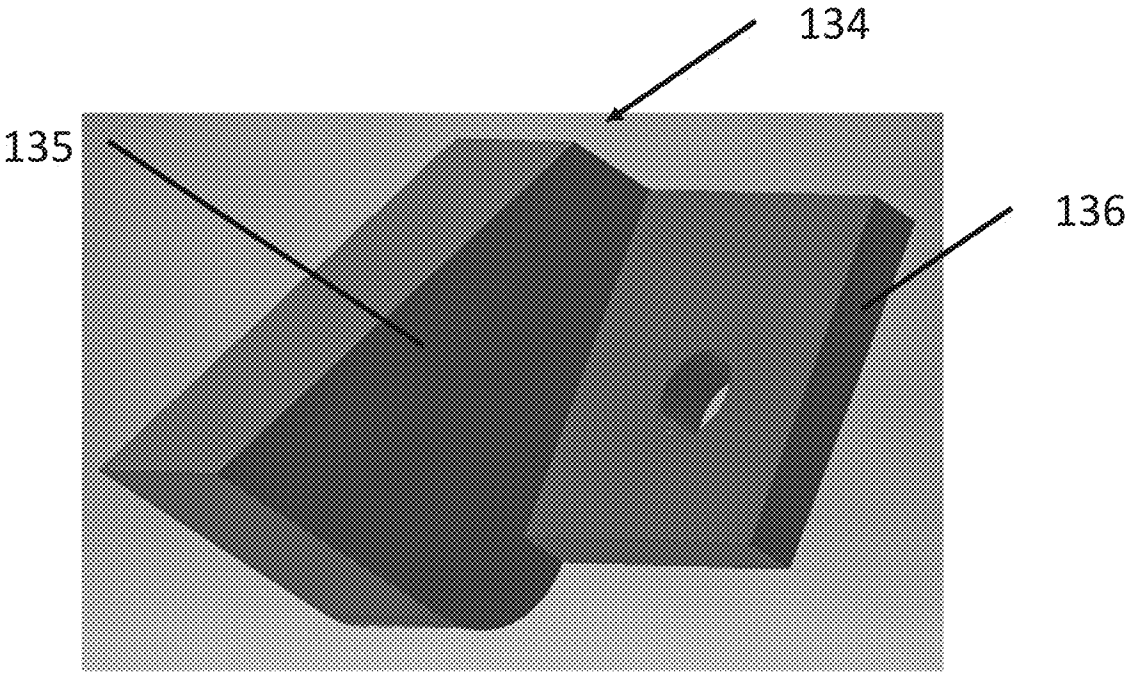
FIG. 5 depicts a perspective view of a key according to an embodiment of the present disclosure.
Figure 6:
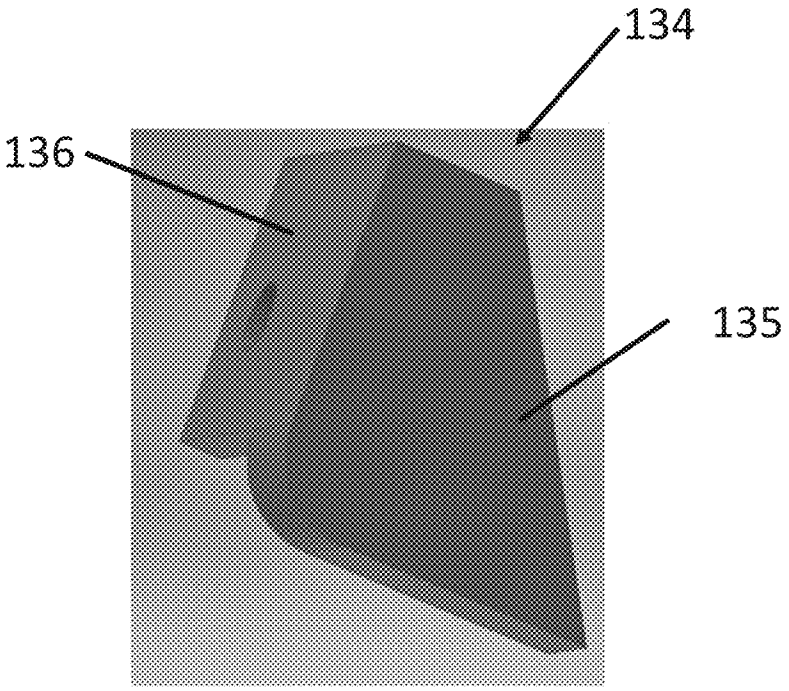
FIG. 6 depicts a further perspective view of the key of FIG. 5.

Referring now to FIGS. 5 and 6, a key 134 is shown in detail. The key 134 has a main body portion 135 that is received in opening 145 of the drawbar body. A flange 136 extends from main body portion 135. Flange 136, as noted above, is received in shallow well 147 in the drawbar body. Flange 136 may be a plate having parallel opposing sides, and being thin relative to main body portion 135. As flange 136 is relatively thin, well 147 which receives flange 136 is relatively shallow. The bore shown in flange 136 is to receive a fastener to connect to the drawbar body via the corresponding bore in the shallow well 147. The flange 136 is transverse to the body 135 of the key. The arrangement of the bore through the flange, orthogonal to the planar surfaces of the flange 136, provides that the fasteners will not be in tension.

The keys are of a sufficiently strong composition to transfer the load of a vehicle being towed. In embodiments, the keys may be solid cast pieces of a suitable steel alloy. In embodiments, the keys may be of other suitable high strength metal alloys, and may be entirely solid or may have one or more voids defined therein. The body 135 of the keys is of sufficient thickness to transfer the load anticipated for the application.

In the event of, for example, a collision sufficient to release both the first releasable connection joining the drawbar body to the draft gear, and a second release mechanism, such as fasteners 150 joining the drawbar body to the drawbar tail, it may be necessary to tow a vehicle away from an accident site in order to perform repairs. Visual inspection of the coupling apparatus of the vehicles that have been involved in the collision will confirm that keys 132, 134 are in position in the openings in the drawbar body. Upon towing, the drawbar tail will travel in the path until stopped by the keys 132, 134. The keys 132, 134 will transfer forces between the drawbar tail and the drawbar body, permitting towing. Once the towed vehicles have arrived at a repair facility, the keys may be removed by removal of their fasteners.

While the foregoing invention has been described with reference to the above-described embodiments, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A drawbar for a rail vehicle coupler comprising:

a first portion configured at a distal end for connecting to a first vehicle;

a second portion comprising a housing for receiving a dampening device, for connection to a second vehicle, the second portion configured for engagement with a proximal end of the first portion; and a block inserted in the second portion via an opening in a sidewall of the second portion;

wherein the first and second portions are configured for connection via a release mechanism, and, wherein, responsive to release of the release mechanism, the release being responsive to application of buff forces above a threshold greater than zero, the first and second portions are slidably movable in a first direction, and slidably movable in a second direction, opposite to the first direction, to the block.

2. The drawbar of claim 1, wherein the block is press fit in the opening.

3. The drawbar of claim 1, wherein the block is fixed to the second portion via a fastener.

4. The drawbar of claim 1, further comprising a second block inserted via a second opening in a wall of the second portion.

5. The drawbar of claim 1, wherein the block comprises a main body and a flange, the flange having a bore for receiving a fastener for attachment to the second portion.

6. The drawbar of claim 1, wherein the block is solid steel.

7. A drawbar for a vehicle coupler, comprising:

a drawbar tail, the drawbar tail configured at a distal end for connecting to a vehicle, and at a proximal end for engagement with a drawbar body;

the drawbar body, the drawbar body configured for receiving a draft gear, the drawbar body further defining a path for linear movement of the proximal end of the drawbar tail along a longitudinal axis of the drawbar body, a key inserted via an opening in a sidewall of the drawbar body to rest in the path.

8. The drawbar of claim 7, wherein the key has a main body press fit in the opening.

9. The drawbar of claim 7, wherein the key is fixed to the drawbar body via a fastener.

10. The drawbar of claim 7, further comprising a second key inserted via a second opening in the drawbar body.

11. The drawbar of claim 7, wherein the key comprises a main body and a flange, the flange having a bore for receiving a fastener for attachment to the drawbar body.

12. A drawbar body for a vehicle coupler, comprising:

a portion for releasable connection to a draft gear;

a top plate, having upstanding parallel rails, the parallel rails each having grooves defined in inner faces of the rails, for receiving and defining a linear path along a longitudinal axis of the drawbar body for travel of a plate of a drawbar tail; and an opening through a wall of the drawbar body and into at least one of the grooves, for receiving a key.

13. The drawbar body of claim 12, wherein the opening is in a sidewall of the drawbar body.

14. The drawbar body of claim 12, wherein the drawbar body further has a well defined therein, bordering the opening, for receiving a flange of the key.

15. The drawbar body of claim 12, further comprising a second opening through an opposite wall of the drawbar body and into another one of the grooves for receiving a second key.

* * * * *